United States Patent [19]

Andrews et al.

[11] Patent Number: 4,844,207

[45] Date of Patent: Jul. 4, 1989

[54] TREE LADDER

[76] Inventors: Dale D. Andrews, 510 Clark St., Big Rapids, Mich. 49307; Durwood T. Andrews, 8245 Elder Rd., Stanwood, Mich. 49346

[21] Appl. No.: 183,612

[22] Filed: Apr. 19, 1988

Related U.S. Application Data

[63] Continuation-in-part of Ser. No. 124,872, Nov. 24, 1987, Pat. No. 4,762,200.

[51] Int. Cl.[4] ..... E06C 1/10; E06C 1/36

[52] U.S. Cl. ..... 182/151; 182/100; 182/178; 182/189; 182/206

[58] Field of Search ..... 182/100, 189, 206, 178, 182/150

[56] References Cited

U.S. PATENT DOCUMENTS

| | | | |
|---|---|---|---|
| D. 185,212 | 5/1959 | Klages . | |
| 826,863 | 7/1906 | Lynch | 182/189 |
| 1,028,453 | 6/1912 | Glover | 182/189 |
| 1,488,413 | 3/1924 | Towse | 182/100 |
| 2,052,439 | 8/1936 | Bailey . | |
| 3,057,431 | 10/1962 | George . | |
| 3,995,714 | 12/1976 | Brookes | 182/100 |
| 4,002,223 | 1/1977 | Bernkrant . | |
| 4,257,490 | 3/1981 | Bandy . | |
| 4,467,890 | 8/1984 | McCallum | 182/189 |
| 4,762,200 | 8/1988 | Andrews | 182/189 |

*Primary Examiner*—Reinaldo P. Machado

*Attorney, Agent, or Firm*—Varnum, Riddering, Schmidt & Howlett

[57] ABSTRACT

A sportsman's ladder for allowing convenient climbing of trees and the like includes a number of sections assembled together in telescoping relationship. Each section has secured thereto a plurality of spaced-apart steps extending laterally from opposite sides thereof in an alternating manner. The ladder further includes a tree engaging means for mounting the ladder to a tree.

26 Claims, 4 Drawing Sheets

TREE LADDER

CROSS REFERENCE TO RELATED APPLICATION

This application is a continuation-in-part application of U.S. patent application Ser. No. 07/124,872 filed Nov. 24, 1987, entitled TREE LADDER, and now U.S. Pat. No. 4,762,200.

FIELD OF THE INVENTION

This invention relates to collapsible, portable ladders of a type for use by sportsmen in the field for climbing trees and the like.

BACKGROUND OF THE INVENTION

It is well known among hunters that the success of the hunt depends, in the broadest context, upon a successful chance encounter of the hunter with the game being hunted. Accordingly, hunters have applied great ingenuity to the task of maximizing the likelihood of such chance encounters.

One approach to hunting which is practiced with a great degree of skill by many hunters is tracking of hunted game. Tracking, however, is not without its difficulties and shortcomings. For example, as tracking necessarily involves movement by the hunter, potentially over a fairly large area, tracking may be rather tiring, especially in rough terrain or severe weather conditions. Additionally, while tracking an animal, a hunter will potentially be within the line of vision and scent range of any animal which he might sight at a near enough distance to get off a safe and sure shot at the game. The equipment load which a hunter must carry also adds to the difficulties of game tracking.

An alternative approach to hunting which is especially popular with bow hunters is to sit or "perch" in a tree and quietly await the chance passing of game. Perching offers several advantages over tracking, including elimination or abatement of all the above-mentioned shortcomings.

Despite its advantages, perching has not been without its shortcomings. For example, the tree that is chosen by any given hunter as the most desirable observation point may not be a tree that is well suited to easy climbing. Additionally, the somewhat bulky and heavy hunting clothes as well as the considerable hunting gear which the hunter carries will tend to increase the difficulty of climbing even an otherwise easy-to-climb tree. Accordingly, there have been efforts in the prior art to provide ladder devices for use by hunters to conveniently effect the desired tree climbing without adding undue burdens of additional equipment to the considerable equipment which the hunter must carry in any case.

For example, U.S. Patent 3,057,431, issued Oct. 9, 1962 to George, discloses a combination ladder and seat that may be used by hunters to climb and perch in a tree. The ladder comprises upper and lower sections which are pivotally affixed together, with each section including a pair of spaced-apart, longitudinal stiles or rails and a plurality of steps extending therebetween. A seat is pivotally mounted adjacent the uppermost end of the upper section. The seat is provided with a fastening system to secure the ladder at an elevated location about the vertically-extending tree trunk.

The conventional ladder construction of the George Patent comprising spaced apart longitudinal stiles with steps extending therebetween is also shown in U.S. Pat.

No. 4,002,223, issued January 11, 1977, to Bernkrant. Specifically, Bernkrant discloses a ladder with telescopically collapsible side stiles, and hooks adjacent the uppermost end of each stile, whereby the ladder may be secured to a structure by placing the hooks over a generally horizontal structural member such as the railing of a boat. Similar hook portions on a ladder for similar purposes are also disclosed in U.S. Patent Des. 185,212, issued May 19, 1959, to Klages.

Another type of prior art ladder which is distinguishable from the ladder structures of the above-cited patents is a pole type ladder which is characterized by a single longitudinally extending structural member having steps extending laterally to opposite sides thereof. Such pole type ladders are known to be designed as multisection structures suited for easy knockdown or collapse of the ladder into a compact package, and including securing elements which are operative to secure the uppermost end of the ladder with respect to a vertically extending member such as a utility pole or a tree trunk. For example, U.S. Pat. No. 3,995,714, issued Dec. 7, 1976 to Brookes, et al, discloses a multisection, knockdown ladder comprising plural sections of elongated tubular construction with steps extending at spaced locations perpendicularly outward of the tubular sections. A securing structure including an arcuate hook member is mounted adjacent the uppermost end of the Brookes ladder and is operable to encompass a pole or tree trunk to secure the uppermost end of the ladder with respect thereto U.S. Pat. No. 4,257,490, issued March 24, 1981, to Bandy discloses a collapsible pole type ladder, a platform mounted to the same adjacent an uppermost end thereof, and a securing structure also being mounted adjacent the uppermost end of the ladder to cooperate with the platform in securing the uppermost end of the ladder with respect to a vertically extending member such as a tree trunk.

U.S. Pat. No. 2,052,439, issued Aug. 25, 1936, to Bailey discloses an extensible fireman's ladder comprising, in part, a pair of upper and lower main posts, the upper post being telescopically engageable within the lower. The upper post is provided with pairs of upwardly folding spring biased steps which are pivotally mounted thereto at suitable intervals and which pivot to a collapsed or clear position in response to telescopic collapsing of the upper pole member into the lower. The Bailey Patent also discloses a pair of retention hook members secured at laterally spaced locations with respect to the uppermost end of the ladder, the hook members being laterally pivotal with respect to the ladder.

In spite of the prior efforts in the art at developing portable ladders, there remains a need for a portable, lightweight, reliable, versatile and convenient climbing system for use by hunters to scale trees in the field. Because a hunter's ladder must be hand carried into the field, it must be durable and lightweight, as well as compact and not of unwieldy construction. By the same token however, to serve with intended purpose it must also offer superior structural qualities as well as convenience, safety and reliability in use.

Portable ladders of more complex structure, and especially those with an undue number of movable or adjustable parts, may prove to be unreliable after long term exposure to the elements in the field. Likewise, many known ladders of sufficient structural strength to serve the purpose are also unduly heavy and cumbersome and not well suited to be hand carried into the field by a hunter.

SUMMARY OF THE INVENTION

According to the invention, a pole-type ladder comprises a central longitudinally extending section, a plurality of steps projecting substantially transversely from opposite sides of the central section and means for mounting the ladder to a lateral support.

The mounting means comprises a hook means on the central section, adapted to engage the lateral support, and defining an opening adapted to receive the lateral support when the hook means is engaged with the lateral support.

The mounting means also comprises a gusset means secured to the hook means for rigidifying the same to resist torsional forces exerted on the hook means when the hook means is engaged with the lateral support and downward and lateral forces are exerted on the steps. The gusset means is also adapted to center the lateral support with respect to the opening to limit movement of the ladder with respect to the lateral support when the hook means is engaged with the lateral support.

The ladder also comprises a stiffening means connected to the gusset means, mounted to and extending along a longitudinal axis of the central section and for rigidifying the central section adjacent the hook means.

In one embodiment of the invention, the ladder further comprises means positioned at a plurality of loci along the longitudinal axis of the central section for adding rigidity to the section by work hardening the same at the loci and for positioning the steps in spaced apart relationship to the lateral support when the hook means is engaged with the lateral support.

The rigidifying and spacing means comprises a plurality of generally U-shaped bends formed in and spaced along the longitudinal axis of the central section and extending outwardly therefrom in a direction opposite to the direction in which the hook means extends from the central section. The steps are secured to the central section at the U-shaped bends such that the steps are offset with respect to the longitudinal axis of the central section and positioned in spaced apart relationship to the lateral support when the hook means is engaged with the lateral support.

In a further embodiment of the invention, the pole-type ladder comprises a central longitudinally extending section having an upper end and a number of steps projecting from opposite sides of the central section. In addition, the ladder comprises attachment means on the central section upper end and comprising first and second attachment means. The first attachment means is adapted to removably attach to the central section upper end a first mounting means adapted to engage a lateral support extending generally normal to a longitudinal axis of the central section to mount the ladder to the lateral support. The second attachment means is adapted to removably attach to the central section upper end a second mounting means adapted to embrace a lateral support extending generally parallel with the longitudinal axis of the central section to mount the ladder to the lateral support.

The first mounting means comprises a generally U-shaped hook defining an opening and having a leg. The first attachment means comprises a first sleeve on and positioned in axial alignment with the central section upper end and adapted to telescopically receive the hook leg. The first attachment means also includes a first securing means for securing the hook leg in telescopic engagement with the first sleeve.

The second mounting means comprises a pair of curved arms. The second attachment means comprises a pair of second sleeves secured to the first sleeves, positioned generally normal to the longitudinal axis of the central section, extending outwardly therefrom in generally opposite directions and adapted to telescopically receive the arms. The attachment means also includes a second securing means for securing the arms in telescopic relationship to the second sleeves.

BRIEF DESCRIPTION OF THE DRAWINGS

The invention is described hereinbelow with reference to the accompanying drawings, in which.

DESCRIPTION OF THE PREFERRED EMBODIMENTS

Figure 1:
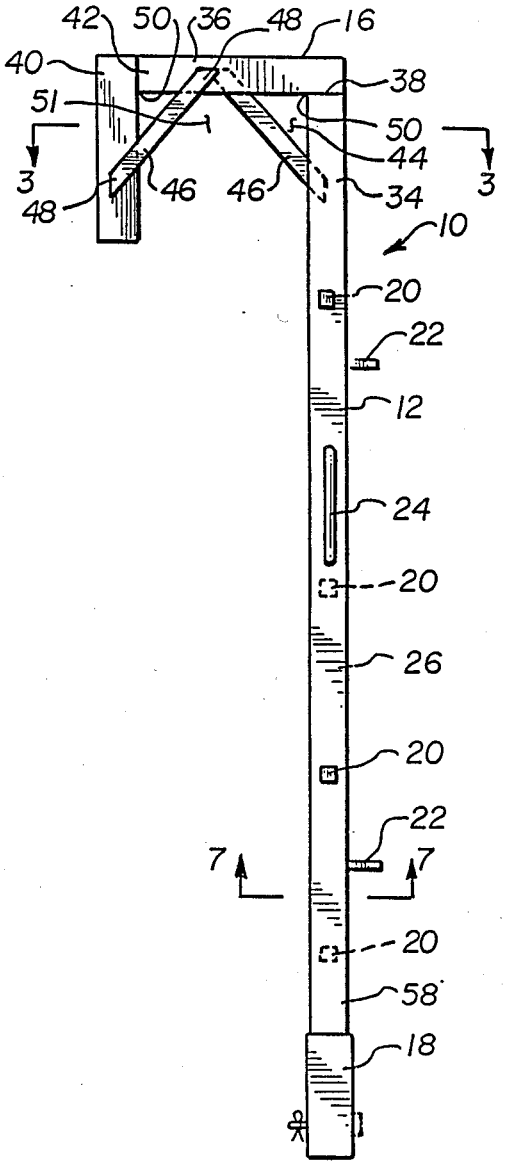
FIG. 1 is, a side elevational view of an upper section of a ladder according to the invention.
Figure 2:
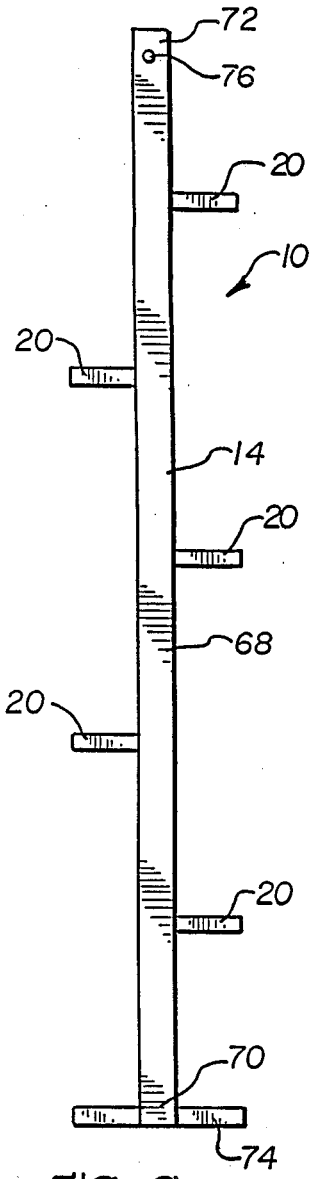
FIG. 2 is a frontal elevational view of a lower section of the ladder.

As shown in FIGS. 1 and 2, a portable, knockdown, pole-type ladder 10 comprises an upper section 12 and a lower section 14. Although, additional intervening sections may be included between the upper and lower sections 12, 14, for purposes of this description, only the upper and lower sections are described.

The upper section 12 is a unitary structure of suitable metal stock, for example one-inch square aluminum alloy tubing such as 6061-T6 aluminum alloy. The upper section 12 includes a downwardly-opening branch engaging hook 16 adjacent its upper end 34, and a connection assembly 18 adjacent its lower end 58 for connection thereof a connection portion 72 of the lower section 14. Upper section 12 further comprises a plurality of longitudinally spaced steps 20, a pair of angular cleats 22 and a carrying handle 24, all of which are rigidly secured to an elongated, generally square, tubular aluminum alloy structural member designated as main body portion 26 of upper section 12 and extending intermediate the connection assembly 18 and the hook 16.

Figure 5:
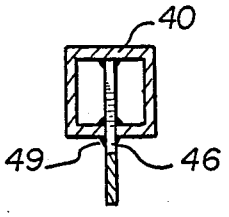
FIG. 5 is a sectional view of a third embodiment of the hook taken on a line similar to that taken with respect to FIGS. 3 and 4.

As shown in FIG. 5, the cleats 22 are rigidly secured to the main body portion 26 at longitudinally spaced locations as by weldments 28. Each cleat 22 is an L-shaped member, includes a base 30 which projects laterally outward of the member 26, and a retention arm 32 which projects generally perpendicular to base 30 and in conjunction therewith and with an adjacent sidewall 33 of main body portion 26 forms a pocket to receive the lower section 14. The cleats 22 are spaced longitudinally of main body portion 26 to provide suitable support of the lower section 14 with respect to the upper section 12 in stacked relationship.

As shown in FIG. 1, the handle 24 extends generally longitudinally of main body portion 26 and is rigidly affixed thereto as by welding at a location generally coincident with the point of balance for the upper section 12 with the lower section 14 being carried in the cleats 22 as above described.

The steps 20 are of the same structural material as the other elements of ladder 10 but may be of smaller dimension stock, for example a smaller cross-section square tube stock. Each step 20 is rigidly secured to one or the other of opposite lateral sides of main body portion 26, as by welding, so as to project laterally therefrom in a cantilever fashion. Steps 20 thus extend generally within a common plane that is coincident with the longitudinal axis of main body portion 26. Preferably, steps 20 project alternately from opposite sides of main body portion 26, as shown in FIGS. 1 and 2, to provide respective left and right steps. This arrangement of the steps 20 provides improved convenience in manipulating the upper section 12 among branches and other obstacles thereby greatly facilitating carrying of the ladder into the field, and of hoisting the ladder up into a tree as would be done by a user who wishes to reach a higher location in the tree. The use of the alternating left and right step pattern also saves on structural material, and therefore on the total weight of the ladder.

Figure 3:
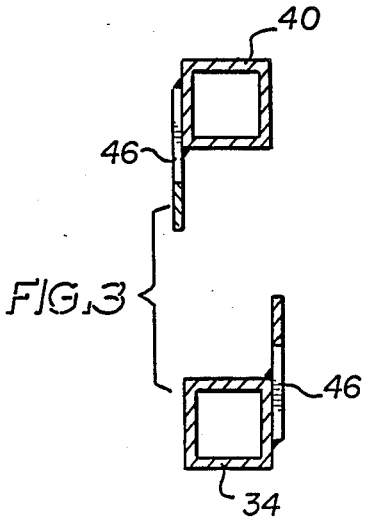
FIG. 3 is a sectional view of a hook of the ladder taken on of FIG. 1.

As illustrated in FIGS. 1 and 3, the hook 16 comprises the upper end 34 of the main body portion 26, a transverse member 36 affixed as by welding to the uppermost end 34 of main body portion 26 and extending transversely therefrom in a direction generally perpendicular to the plane of steps 20, and a return member 40 which projects downwardly from the outer end 42 of the transverse member 36. These elements form a downwardly opening pocket 44 which is adapted to overlie and contain a tree limb to secure the ladder 10 with respect to the tree being climbed.

Figure 4:
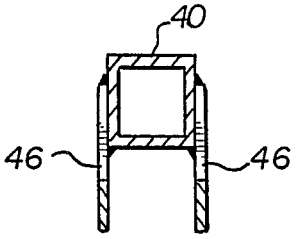
FIG. 4 is a sectional view of a second embodiment of the hook taken on a line similar to that taken with respect to FIG. 3.

The hook 16 is reinforced by gussets 46 formed as elongated plate-like members, the longitudinal ends 48 of which are rigidly secured to members 34, 36, 40. In a preferred embodiment of the ladder 10, as shown in FIGS. 1 and 3, one gusset 46 is rigidly secured to members 34, 36 on one side of the hook 16, and another gusset is secured to members 36, 40 on the other side of the hook. In an alternative embodiment, as shown in FIG. 4, 4 gussets are employed, with one pair of gussets secured to and between members 34, 36 on opposite sides of the hook, and another pair of gussets secured to and between members 36, 40 on opposite sides of the hook. This arrangement provides additional reinforcement to hook 16. In a third embodiment, as shown in FIG. 5, a pair of gussets 46 are rigidly secured to and extend through slots 49 within adjacent side walls of members 34, 36, 40. Other alternative structures for the gussets 46 are also contemplated, including but not limited to gusset plates generally of a triangular shape (not shown) which reside within and are welded to interior corners 50 of hook portion 16, and square or similarly configured tubing sections cut to occupy the corners 50, or to extend across the corners 50.

In all of the above described embodiments, the hook 16 includes gussets 46 secured and positioned at angles to members 34, 36, 40 so as to form a V-shaped opening 51 which receives a branch in more or less centered orientation within the pocket 44. The V-shaped opening 51 allows the weight of the ladder 10 and climber to enhance engagement of the ladder on the branch that is engaged thereby so that all modes of potential movement of the hook 16 with respect to the tree are minimized. For example, for and aft freeplay of hook 16 with respect to the branch engaged thereby is eliminated, as is substantially all lateral or side-to-side wobble, as will be discussed hereinbelow.

An alternative to welded construction of the hook 16 would entail bending of the upper end 34 of the main body portion 26 into the desired hook form and welding the gussets 46 thereto. Still another alternative which combines bending and welding would entail cutting of deep V-shaped notches (not shown) at suitable locations in main body portion 26 to permit bending thereof into a hook formed with the V-shaped notches located at the corners 50 and the sides of the notches coming together after bending to be then welded together to form a unitary structure.

For further reinforcement of the hook portion 16, transverse member 36 may have a metal insert (not shown) such as a $\frac{3}{4}$ inch square bar of identical aluminum alloy telescopically placed therein.

Figure 6:
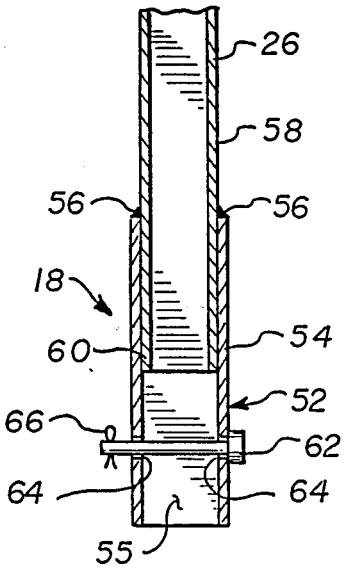
FIG. 6 is a sectional view of the upper section of FIG. 1.
Figure 7:
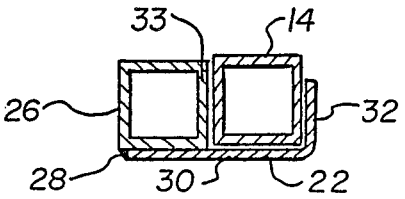
FIG. 7 is a sectional view taken on line 5—5 of FIG. 1.

Referring to FIG. 6, the connection assembly 18 comprises an enlarged portion 52 of upper section 12, which may be, for example, a square section aluminum alloy sleeve 54 which is fixedly secured as by welding at 56 to a lower end 58 of main body portion 26 to form an open-ended pocket 55 outwardly adjacent a terminal end 60 of main body portion 26. The terminal end 60 of main body portion 26 projects into the sleeve 54 and is closely engaged therein to provide suitable strength for the assembly 18. Due to he square cross-section of the sleeve 54 and the main body portion 26, a 4-corner interlocking engagement therebetween is realized which provides ample support for transmission of torque loads therebetween without danger of unduly stressing welds 56. A clevis pin 62 extends within a pair of aligned bores 64 formed within sleeve 54 longitudinally outward of terminal end portion 60 and a hitch pin 66 is provided to captively retain clevis pin 62 in registry with the aligned bores 64.

As shown in FIG. 2, the lower section 14 of ladder 10 is preferably constructed of the same aluminum alloy as used for upper section 12 and comprises an elongated main body member 68 which extends intermediate a base portion 70 and the connection portion 72. A plurality of steps 20 are rigidly secured to main body member 68 at spaced locations in precisely the same manner as that described above with regard to the steps 20 of the upper section 12. It is noted, however, that the length of main body member 68 is selected, with regard to the suitable spacing of steps 20, such that the distance between the uppermost step 20 of upper section 14 and the lowermost step 20 of upper section 12 will be of sufficient distance to facilitate convenient use when the ladder sections 12, 14 are assembled. A base 74 is rigidly secured to the base portion 70 of the main body member 68. The base 74 serves to support the ladder 10 with respect to the ground and may be supplemented by tying thereof to a stake (not shown) driven into the ground or to the base of the tree (not shown). Alternatively, a suitable eyelet (not shown) may be provided adjacent the base 74 for such tying off and securing.

Adjacent the connection portion 72 of main body member 68 a through bore 76 is provided. The through bore 76 is positioned for registry with bores 64 when the upper and lower to sections are positioned in telescoping engagement as described below.

To assemble the ladder 10, the connection portion 72 of the main body member 68 is inserted into pocket 55 and then clevis pin 62 is inserted through the aligned bores 64, 76. The hitch pin 66 is then installed to provide positive retention of the two sections 12, 14 with respect to each other. As above noted with regard to retention of upper body portion 26 with respect to sleeve 54, the mating corners of the square cross-sections of connection portion 72 and pocket 55 carry substantially all torque loads to thereby relieve clevis pin 62 of shear loads and eliminate any danger of clevis pin shearoff in use.

An alternative structure for connection assembly 18, for use in lieu of the sleeve 54, would entail enlargement or expansion of the lower end 58 of main body portion 26 to provide an enlarged section portion (not shown) thereof having interior cavity dimensions suitable to slidably receive the connection portion 72 of lower section 14 therein.

An alternative embodiment of the ladder 10 is illustrated in FIGS. 8–16. In this embodiment, the ladder 10 comprises a vertical support 101 having upper, center, and bottom sections 100, 102, 104, respectively. Although a plurality of center sections 102 may be inserted between the top and bottom sections 100, 104, for purposes of this description, only one center section is discussed.

Figure 8:
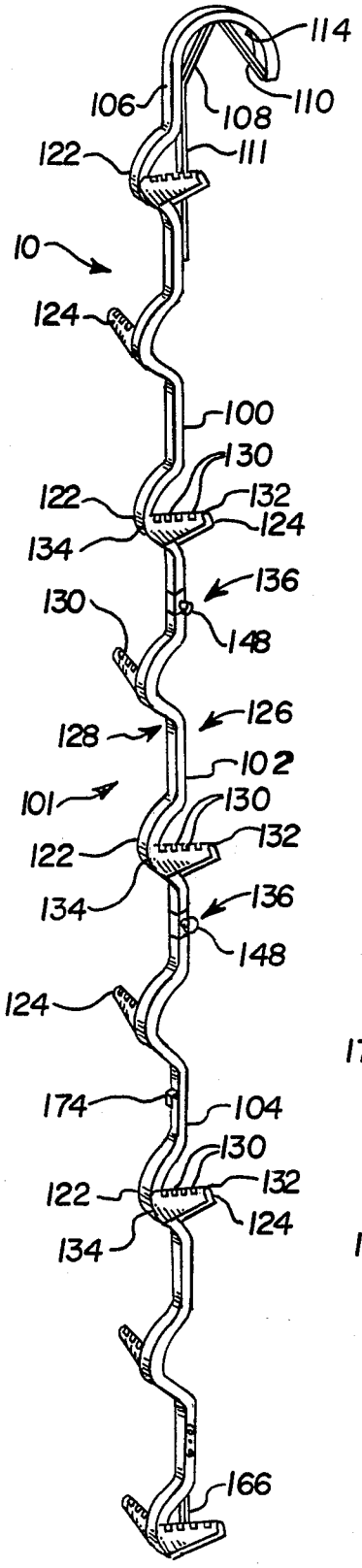
FIG. 8 is a front perspective view of a second embodiment of the ladder.
Figure 10:
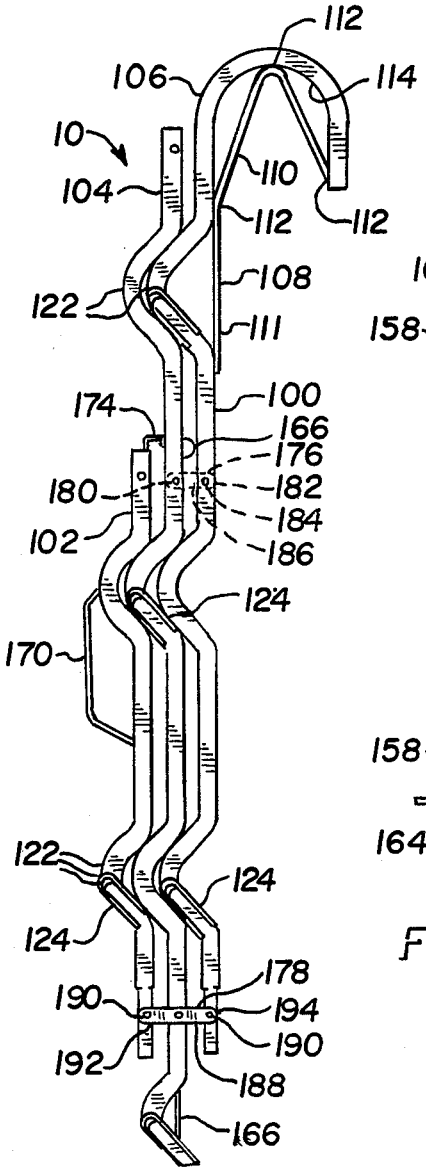
FIG. 10 is a side elevational view of the ladder of FIG. 8 showing a stacking arrangement.

As shown in FIGS. 8 and 10, the upper section 100 includes an upper curved portion forming a U-shaped hook 106. Positioned within the hook and extending downwardly along the upper section 100 is a gusset 108 of U-channel stock metal bent obliquely in two places to form a triangular portion 110 rigidly secured as by welding to the hook 106. The gusset 108 interfaces the hook 106 at three points 112 within the inner curved surface 114 of the hook. The gusset 108 functions to strengthen the hook 106 and aids in securing the ladder 10 to a tree as discussed in connection with the above-described embodiment. An elongated gusset leg 111 extends downwardly along the upper section 100 to stiffen the hook portion of the ladder.

Figure 9:
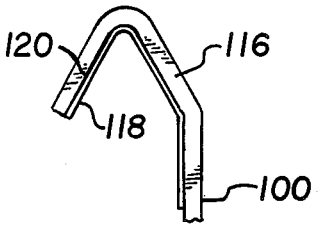
FIG. 9 is a partial side elevational view of a second embodiment of a hook-shaped upper portion of the ladder of FIG. 8.

An alternate form of the ladder hook portion is illustrated in FIG. 9. This embodiment eliminates the need for a gusset by having a triangular-shaped hook 116 substantially similar to the shape of the above-described gusset 108. The triangular shape of the hook provides the required structural strength without the necessity of a gusset. To aid the hook 116 in gripping a supporting surface (e.g., a tree branch), a ribbed piece 118 of U-shaped metal stock is mounted by welding the web of the metal stock to the inner surface 120 of the hook.

As illustrated in FIGS. 8 and 10, each section 100, 102, 104 of the ladder 10 includes a plurality of arcuate bends 122 positioned along the length of the section. The bends are coplanar relative to the hook 106, but are directed away from the same. The bends 122 serve to strengthen the ladder 10 by work hardening the metal at the bend locations. They also function to provide more hand and foot space between the ladder and a supporting tree or wall. The ladder upper, center, and bottom sections 100, 102, 104, respectively, are preferably formed of either steel or aluminum.

Figure 13:
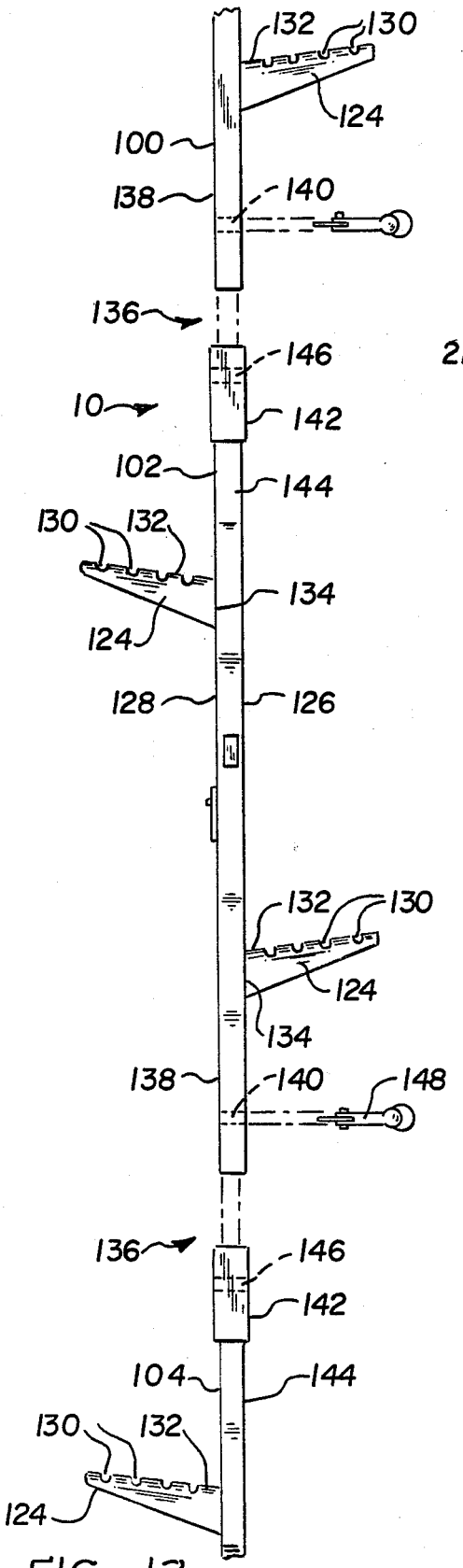
FIG. 13 is a partial exploded front elevational view of the ladder of FIG. 8 showing the ladder segments and lock pins.

As shown in FIGS. 8, 10 and 13, rigidly fastened as by welding to the vertical support 101 are a plurality of steps 124. The steps are longitudinally spaced and alternate along each lateral side 126, 128 of the ladder 10. Each step is formed of a generally triangular piece of flat stock metal, preferably of steel or aluminum, having a plurality of holes drilled along a central axis thereof. The metal is folded along the axis such that the holes form notches 130 extending along a foot-engaging surface 132 of the step 124. The step edge 134 is rigidly fastened as by welding to the ladder 10, such that the foot-engaging surface 132 faces upwardly and is canted slightly upwardly towards the vertical support. In this manner, if the user's hands or feet begin to slip from a steps 124, they will tend to slip inwardly toward the vertical section. Thus, the canting reduces the tendency of the hands or feet to slip off the ladder 10. The notches 130 provide another safety feature by facilitating the gripping of the steps 124 by the user's hands and feet.

Referring to FIGS. 8 and 13, a connection assembly 136 is provided for assembling the vertical support 101. A bottom portion 138 of a relative upper section (i.e., either the upper section 100 or the center section 102) includes a pair of aligned holes 140 extending therethrough. A collar 142 forming a socket is rigidly secured as by rivets or welding to a top portion 144 of a relative lower section (i.e., either the center section 102 or the bottom section 104). The collar 142 has a pair of aligned openings 146 extending therethrough. The relative upper section is telescopically received in its respective collar 146 such that the holes 140 and openings 146 align. A lock pin 148 is set in registry with the aligned holes and openings to complete the connection.

In an alternate embodiment of the connection assembly 136 the upper end of the relative lower section has an expanded cross section, permitting the relative upper section to slidably mount within the relative lower section without the need for a separate collar 142. In this embodiment, the upper ends 144 of the center and bottom segments 102, 104, respectively, are mechanically expanded by a machine (not shown) having a tool that is inserted within the upper ends 144 to forcibly enlarge the cross-sectional dimensions of the same.

Figure 11:
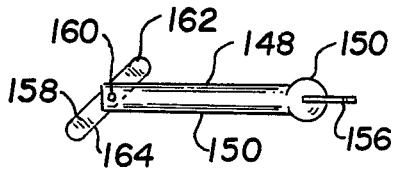
FIG. 11 is a side elevational view of a lock pin for the ladder of FIG. 8.
Figure 12:
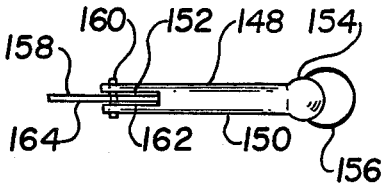
FIG. 12 is a plan view of the lock pin for FIG. 11.

As seen in FIGS. 11 and 12, the lock pin 148 comprises a roll pin 150 having a slot 152 at one end thereof, and a head 154 and an offset circular spring 156 at the other end. The spring is generally semicircular in shape, having ends (not shown) bent inwardly toward the pin and received within pin holes (not shown). A toggle 158 is received within the slot 152 and rotatably mounted to the roll pin by a toggle pin 160. The toggle comprises a flat strip of metal and is mounted to the toggle pin 160 off center so as to have a first toggle side 162 shorter than a second side 164. The first side is rotatable within the slot 152 when the toggle is rotated so as to align the toggle longitudinal axis with the longitudinal axis of the roll pin. In this orientation, the lock pin can be set in or out of registry with the aligned holes 140 and openings 146 of the connection assembly 136. The offset toggle facilitates the ease of grasping the toggle during ladder assembly by enabling the user to grasp a larger toggle segment. The offset toggle also minimizes the length of the slot 152 to thereby increase the overall strength of the pin 148.

To assemble two ladder segments, the bottom portion 138 of the relative upper segment is placed within the relative lower segment collar 142 and a lock pin 148 is inserted into the aligned holes 140 and openings 146. Specifically, the toggle 158 is aligned with the longitudinal axis of the pin 148. The pin can then be inserted through the aligned holes and openings. The toggle is then rotated perpendicularly to the lock pin longitudinal axis. The circular spring 156, which is normally aligned with the pin axis, is rotated so it presses against the collar 142. The resulting pressure tends to pull the pin head portion 154 away from the ladder, thereby engaging the toggle 158 securely against its respective side of the ladder segment. The ladder segments are thereby securely joined together.

As best seen in FIG. 10, there are a plurality of eyelets 166 on the bottom ladder section 104. The eyelets are used for securing safety straps (not shown) to and between the ladder 10 and a supporting tree. Although the straps are not necessary for securing the ladder to the tree, they provide a safety feature to assure that the ladder will remain stable.

As illustrated in FIG. 10, the ladder upper, center, and bottom sections 100, 102, 104, respectively, may be stacked for ease of carrying and storage. The sections are stacked vertically, with the upper section 100 on the bottom of the stack, the bottom section 104 in the middle, and the center section bends 102 on the top. In this manner, the section arcuate bends 122 are aligned and the hook 106 or 116 of the upper section 100 faces downwardly. A handle 172 is mounted in the middle of the center section 102 to facilitate carrying of the ladder 10.

An L-shaped bracket 174 is rigidly mounted as by welding at a predetermined location on the bottom section 104. The bracket 174 is slidably received within the center section when the sections are stacked together as illustrated in FIG. 10. The bracket 174 thereby aids in removably fastening the sections together during the stacking operation. To further secure the ladder sections together, the bottom section 104 has two flat brackets 176, 178 rotatably fastened as by rivets at forward and aft locations 144, 138, respectively. The forward bracket 176 rotatably mounts by a pins means at a first end 180 thereof to the bottom section. The forward bracket second end 182 has a hooked slot 184 adapted to receive a pin 186 mounted to the upper section 100 to partially secure the upper and bottom sections together in stacked relationship.

The aft bracket 178 is rotatably mounted at its center portion 188 to the bottom section 104 by a pin 189. A hole 190 is located at a predetermined location at each end 192, 194 of the aft bracket. To secure the bracket to the center and upper sections 102, 100, respectively, the bracket 178 is rotated so the bracket holes 190 align with the holes 140 of the connection assembly 136 in the center and upper sections. Lock pins 148 are then inserted into the aligned holes 140 to removably secure the three ladder sections together. When the ladder 10 is assembled for use, the forward and aft brackets 176, 178, respectively, may be pivoted to align with the longitudinal axis of the ladder so they do not interfere with the use of the ladder.

Figure 14:
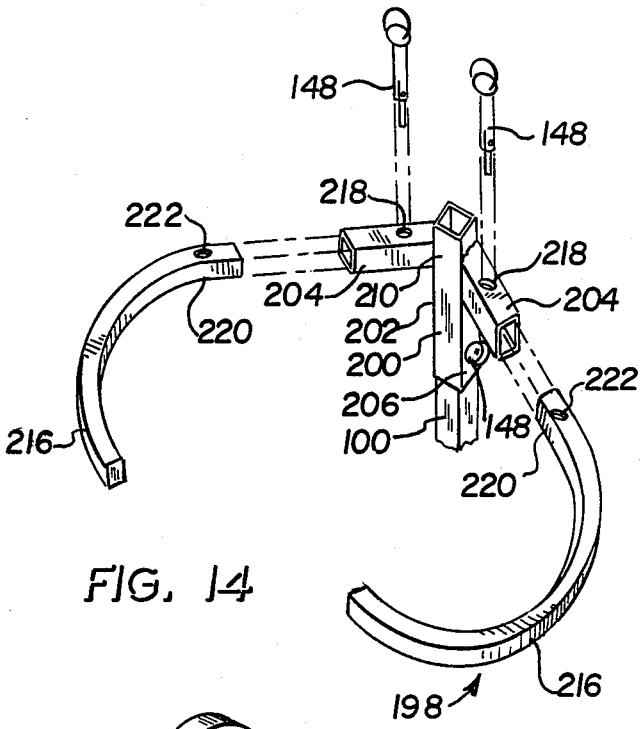
FIG. 14 is a partial perspective view of a fourth embodiment of the ladder having a union at a ladder upper end showing an exploded view of an optional interchange clamping means.
Figure 16:
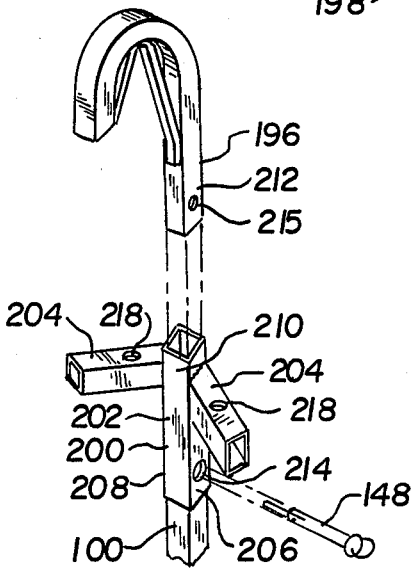
FIG. 16 is a partial perspective view of the ladder of FIG. 14 showing an exploded view of an optional in hooking means.
Figure 15:
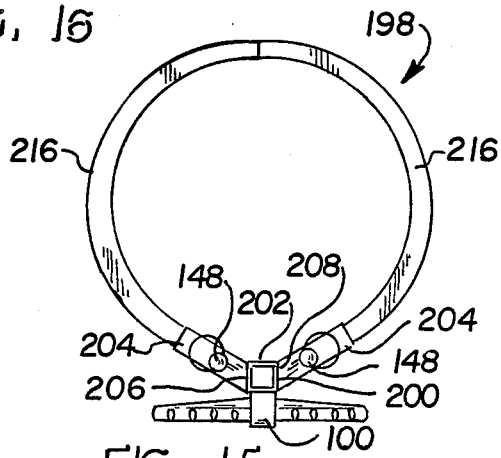
FIG. 15 is a plan view of the ladder embodiment of FIG. 14 showing the clamping means in a closed position.

Referring now to FIGS. 14 to 16, there is shown another ladder embodiment comprising an interchangeable hook 196 and clamp 198 removably mounted to the ladder upper section 100. In this embodiment, the upper end 144 of the upper section includes a union 200 comprising a main body portion 202 and a pair of branch portions 204. The main body portion comprises rectangular channel stock material and is partially mounted over the top section upper end 144 and rigidly fastened to the same by welding or rivets (not shown). The branches 204 comprise rectangular channel stock material rigidly mounted as by welding to opposite lateral sides 206, 208 of the body portion upper end 210. The branches 204 lie in a horizontal plane and extend outwardly from the body portion at an obtuse angle. The interchangeable hook and clamp components are preferably made of the same material as the ladder 10.

As shown in FIG. 16, the removable hook 196 is J-shaped, having the long hook leg 212 slidably mountable within the union main body 202. A lock pin 148 is inserted through aligned holes 214, 215 in the union 200 and hook 196, respectively, to securely fasten the hook to the ladder upper section 100.

The removable clamp 198 is attached to the ladder upper section 100 when it is desired to climb a tree not having branches from which a hook can be hung. As shown in FIGS. 14 and 15, the clamp 198 comprises two semicircular ring portions 216 having a rectangular cross section. The ring portions are adapted to slidably mount within the union branches 204 so they form an enclosing ring. Specifically ring portion first end 220 slides into a union branch 204. Lock pins 148 are inserted through aligned openings 218 in the ring portions 216 and the branches 204 to secure the ring portions to the branches. The ring portions 216 can be formed with a bend (not shown) so the clamp 198 can accommodate a larger diameter tree trunk. Therefore, a variety of clamps 198 can be fashioned to enable the user to select a clamp that is suitable for a given tree.

To mount the clamp 198 to a tree trunk, the upper ladder section 100 is placed adjacent the tree. The clamp rings 216 are mounted within the union branches 204 so the clamp 198 encompasses the tree trunk. The ladder upper section 100 is raised up the tree, working the clamp around any uneven trunk portions by moving the ladder section back and forth. The center and bottom ladder sections 102, 104, respectively, are subsequently attached as the ladder 10 is raised up the tree.

It is also conceivable that the user may attach both the interchangeable hook 196 and clamp 198 simultaneously to the union, though it is not required for successful operation of the ladder. In addition, both the hook 196 and clamp 198 may be attached for ease of carrying the ladder in the stacked position of FIG. 10.

It will be appreciated that torque loads on a pole type ladder are a primary concern to the user. With a conventional stile-type ladder, side rails of the ladder provide laterally spaced apart support points at the ladder base, and the point at which ladder upper end rests against a supporting structure provides upper end support. Both of these modes of support are well adapted to carry any twisting or torque loads imparted to the ladder by climbing action of the user. In the case of a pole-type ladder, however, the support structure generally is concentrated along the central axis of the main longitudinal structural member of the ladder, and the climbing action of the user therefore imparts significant torquing or twisting load inputs to the ladder structure as the support of the climber's feet generally may be outboard of the ladder support. For this reason, pole type ladders, unless provided with sophisticated retention and support structures, may be subject to lateral wobble alternately to the left and right as the climber proceeds up the ladder, imparting by his alternate steps alternate left and right torque or twisting loads. Of course, as has been noted hereinabove, the prior art does contemplate various modes of support for pole type ladders; however, such structures generally have been complex and therefore expense, have involved moving or adjustable parts, and have been of considerably more weight than is desirable for a portable ladder intended for field use.

According to my invention, a sturdy and stable pole type ladder is provided for use in climbing trees and other irregular structure even though only a single retention structure, as described, is provided for the ladder. Prior ladders have employed multiple laterally spaced hooks, multiple movable hooks, and a varied unduly complex and expensive expedients which were often suitable at best only for securing a ladder with respect to very regular and uniform structures such as those structures presenting a substantially uniform horizontal structural portion to which the ladder retention hooks could be engaged e.g. a boat rail or building roof ledge.

According to the description hereinabove, I have invented a novel and improved sportsman's field ladder of the pole type for use in tree climbing and the like which provides for enhanced and simplified support of the ladder with respect to a tree to be climbed, enhanced economy and simplicity of construction, and enhanced portability through the simplified design and through reduced weight and the unique carrying arrangement which permits the sections of the knockdown ladder to be carried as a single compact package in stacked fashion by means of a single handle.

Of course it will be understood that I have contemplated various alternative and modified embodiments other than those above described, and such would certainly also occur to those versed in the art once apprised of my invention. Accordingly, it is my intent that the invention be construed broadly and limited only by the scope of the claims appended hereto.

I claim:

1. In a pole-type ladder of knockdown construction comprising upper and lower, central, longitudinally-extending sections connectible together in substantially end-to-end relationship, a plurality of steps secured to and extending from opposite sides of said upper and lower sections, connecting means for releasably connecting said upper and lower sections in substantially end-to-end relationship and means on said upper section for mounting said ladder to a lateral support, the improvement wherein:

said mounting means comprises hook means on said upper section, adapted to engage a lateral support and defining an opening adapted to receive a lateral support when said hook means is engaged with a lateral support; said mounting means further comprising gusset means secured to said hook means for rigidifying said mounting means to resist torsional forces exerted on said hook means when said hook means is engaged with a lateral support and downward and lateral forces are exerted on said steps, and for centering a lateral support with respect to said opening to limit movement of said ladder with respect to a lateral support when said hook means is engaged with a lateral support; and said ladder further comprises stiffening means connected to said gusset means, mounted to and extending along a longitudinal axis of said upper section and for rigidifying said upper section adjacent said hook means.

2. A pole-type ladder according to claim 1, wherein said upper section comprises an upper member extending along said longitudinal axis of said upper section, a generally transverse member extending outwardly from said upper member and a downwardly-depending member extending downwardly from said transverse member verse and downwardly-depending members forming a generally U-shaped bend in said upper section; and said hook means comprises said upper, transverse and downwardly-depending members of said upper section, with said opening being defined by said downwardly-opening U-shaped bend;

said gusset means comprises a substantially V-shaped gusset rigidly secured to said upper section and having a first leg positioned between said upper and transverse members and a second leg positioned between said transverse and downwardly-depending members, said gusset means defining a substantially V-shaped pocket within said opening and adapted to receive a lateral support when said hook means is engaged with a lateral support; and said stiffening means forms an elongated extension of said gusset first leg and is rigidly secured to and extends along said longitudinal axis of said upper section.

3. A pole-type ladder according to claim 1 and further comprising rigidifying means positioned at a number of loci along longitudinal axes of said upper and lower sections and for adding rigidity to said upper and lower sections by work-hardening said sections at said loci.

4. A pole-type ladder according to claim 3, wherein said rigidifying means comprising at least one generally U-shaped bend formed in each of said upper and lower sections, said sections being work-hardened at said U-shaped bends.

5. A pole-type ladder according to claim 1, and further comprising spacing means positioned at a number of loci along longitudinal axes of said upper and lower sections and for positioning said steps in spaced-apart relationship to a lateral support when said ladder is mounted to a lateral support.

6. A pole-type ladder according to claim 5, wherein said hook means extends outwardly from longitudinal axes of said upper and lower sections in a first direction;

said spacing means comprises a plurality of generally U-shaped bends formed in and spaced along said longitudinal axes of said upper and lower sections and extending outwardly from said longitudinal axes in a second direction generally opposite to said first direction; and said steps are secured to said upper and lower sections at said U-shaped bends such that said steps are offset with respect to said longitudinal axes and positioned in spaced-apart relationship to a lateral support when said hook means is engaged with a lateral support.

7. A pole-type ladder according to claim 1 and further comprising means positioned at a plurality of loci along longitudinal axes of said upper and lower sections for adding rigidity to said sections by work-hardening said sections at said loci and for positioning said steps in spaced-apart relationship to a lateral support when said hook means is engaged with a lateral support.

8. A pole-type ladder according to claim 7, wherein said hook means extends outwardly from said longitudinal axes of said upper and lower sections in a first direction;

said rigidifying and spacing means comprises a plurality of U-shaped bends formed in and spaced along said longitudinal axes and extending outwardly therefrom in a second direction generally opposite to said first direction; and said steps are rigidly secured to said upper and lower sections at said U-shaped bends such that said steps are offset with respect to said longitudinal axes and positioned in spaced-apart relationship to a lateral support when said hook means is engaged with a lateral support.

9. A pole-type ladder according to claim 8, wherein said upper section further comprises a tubular bottom end and said lower section comprises a tubular top end; and said connecting means comprises a sleeve on and positioned in axial alignment with a central, longitudinal axis of one of said upper and lower sections and in which one of said lower and upper sections, respectively, is adapted to telescopingly engage, a pair of aligned openings extending through opposing walls of said bottom end, a pair of aligned holes extending through opposing side walls of said top end and adapted to align with said aligned openings when said upper and lower sections are telescopingly engaged, and a pin adapted to be received in said aligned openings and holes when said upper and lower sections are telescopically engaged to releasably connect said upper and lower sections in substantially end-to-end relationship.

10. A pole-type ladder according to claim 9, and further comprising fastening means mounted on one of said upper and lower sections and for fastening other of said upper and lower sections to said one section in generally mutually parallel, stacked relationship, with said U-shape bends of said rigidifying and spacing means of said respective sections being set in registry with one another, when said upper and lower sections are not connected together in substantially end-to-end relationship.

11. A pole-type ladder according to claim 10, wherein said fastening means comprises a bracket having first and second portions, pivotably mounted on said one of said upper and lower sections at said first portion and having a bore extending through said second portion, said bracket being adapted to rotate to align said bore with one of said pairs of aligned openings and holes in said other of said upper and lower sections when said sections are not connected together in end-to-end relationship; and said pin is adapted to extend through said aligned bore and one of said pairs of openings and holes to connect together said upper and lower sections in stacked relationship.

12. In a pole-type ladder comprising a central, longitudinally-extending section, a plurality of steps projecting substantially transversely from opposite sides of said central section and means for mounting said ladder to a lateral support, the improvement wherein:

said mounting means comprises hook means on said central section, adapted to engage a lateral support, and defining an opening adapted to receive a lateral support when said hook means is engaged with a lateral support, said mounting means further comprising gusset means secured to said hook means for rigidifying said hook means to resist torsional forces exerted on said hook means when said hook means is engaged with a lateral support and downward and lateral forces are exerted on said steps, said gusset means being further adapted to center a lateral support with respect to said opening to limit movement of said ladder with respect to a lateral support when said hook means is engaged with a lateral support; and said ladder further comprises stiffening means connected to said gusset means, mounted to and extending along a longitudinal axis of said central section and for rigidifying said central section adjacent said hook means.

13. A pole-type ladder according to claim 12, wherein said central section comprises an upper member extending along said longitudinal axis of said central section, a generally transverse member extending outwardly from said upper member and a downwardly-depending member extending downwardly from said transverse member and parallel to said upper member, said upper, transverse and downwardly-depending members forming a downwardly-opening bend in said upper section;

said hook means comprises said upper, transverse and downwardly-depending members of said upper section, with said opening being defined by said downwardly-opening bend;

said gusset means comprises a substantially V-shaped gusset rigidly secured to said central section and having a first leg positioned between said upper and transverse members and a second leg positioned between said transverse and downwardly-depending members, said gusset defining a substantially V-shaped pocket within said opening and adapted to receive a lateral support when said hook means is engaged with a lateral support; and said stiffening means forms an elongated extension of said gusset first leg and is rigidly secured to and extends along said longitudinal axis of said upper section.

14. A pole-type ladder according to claim 12, and further comprising means positioned at a plurality of loci along said longitudinal axis of said central section for adding rigidity to said section by work-hardening said section at said loci and for positioning said steps in spaced-apart relationship to a lateral support when said hook means is engaged with a lateral support.

15. A pole-type ladder according to claim 14, wherein said hook means extends outwardly from said longitudinal axis of said central section in a first direction;

said rigidifying and spacing means comprises a plurality of generally U-shaped bends formed in and spaced along said longitudinal axis and extending outwardly of said longitudinal axis in a second direction generally opposite to said first direction; and said steps are secured to said central section at said U-shaped bends such that said steps are offset with respect to said longitudinal axis and positioned in spaced-apart relationship to a lateral support when said hook means is engaged with a lateral support.

16. In a pole-type ladder comprising a central, longitudinally-extending section having an upper end, a plurality of steps projecting substantially transversely from opposite sides of said central section and mounting means on said upper end for mounting said ladder to a lateral support, the improvement wherein:

said mounting means extends outwardly from a longitudinal axis of said central section in a first direction;

said ladder further includes spacing means comprising a plurality of generally U-shaped bends formed in and spaced along said longitudinal axis and extending outwardly therefrom in a second direction generally opposite to said first direction; and said steps are secured to said central section at said U-shaped bends such that said steps are offset with respect to said longitudinal axis;

whereby said spacing means is adapted to position said steps in spaced relationship to a lateral support when said ladder is mounted to a lateral support.

17. A pole-type ladder according to claim 16, wherein said central section is work-hardened at said U-Shaped bends to add rigidity to said central section at said U-shaped bends.

18. In a pole-type ladder comprising a central longitudinally-extending section having an upper end and a number of steps projecting from opposite sides of said central section, the improvement comprising:

attachment means on said central section upper end and comprising first attachment means for removably attaching to said upper end first mounting means adapted to engage a lateral support extending generally normal to a longitudinal axis of said central section to mount said ladder to a lateral support, said attachment means further comprising second attachment means for removably attaching to said upper end second mounting means adapted to embrace a lateral support extending generally parallel with said longitudinal axis of said central section to mount said ladder to a lateral support.

19. A pole-type ladder according to claim 18, wherein said first mounting means comprises a generally U-shaped hook defining an opening and having a first leg; and said first attachment means comprises a sleeve on and positioned in axial alignment with said longitudinal axis of said central section upper end and adapted to telescopically receive said hook leg, said first attachment means further comprising securing means for securing said hook leg in telescopic engagement with said first sleeve;

whereby said hook is adapted to engage a lateral support extending generally normal to said longitudinally-extending central section, with said hook opening receiving a lateral support, to mount said ladder to a support.

20. A pole-type ladder according to claim 19, wherein said first mounting means further comprises gusset means secured to said hook for rigidifying said hook to resist torsional forces exerted on said hook when said hook is engaged with a lateral support and downward and lateral forces are exerted on said steps, and gusset means being further adapted to center said lateral support with respect to said opening to limit movement of said ladder with respect to a lateral support when said hook is engaged with a lateral support.

21. A pole-type ladder according to claim 20, wherein said hook further comprises a second leg extending transversely outwardly from said first leg and a third leg extending downwardly from said second leg and parallel to said first leg; and said gusset means comprises a substantially V-shaped gusset rigidly secured to said hook between said first, second and third legs, said gusset defining a V-shaped pocket within said hook opening adapted to receive a lateral support when said hook is engaged with a lateral support.

22. A pole-type ladder according to claim 21, wherein said securing means comprises a pair of openings extending through opposing walls of said sleeve and opening means extending through said hook first leg and adapted to align with said openings when said hook first leg is telescopically received in said sleeve, said securing means further comprising a pin adapted to engage said aligned openings and opening means to secure said hook first leg in telescopic engagement with said first sleeve.

23. A pole-type ladder according to claim 18, wherein said second mounting means comprises a pair of curved arms; and said second attachment means comprises a pair of sleeves secured to said first attachment means, positioned generally normal to said longitudinal axis of said central section, extending outwardly therefrom in generally opposite directions and adapted to telescopically receive said arms, said second attachment means further comprising means for securing said arms in telescopic relationship to said sleeves;

whereby said curved arms are adapted to embrace a lateral support extending generally parallel with said central section longitudinal axis to mount said ladder to a lateral support when said arms are mounted to said sleeves.

24. A pole-type ladder according to claim 23 wherein said securing means comprises a pair of openings extending through opposing walls of each of said sleeves and opening means extending through an end of each of said arms, said opening means adapted to align with said openings when said arms are telescopically received in said sleeves, said securing means further comprising a pair of pins adapted to engage sets of aligned openings and opening means to secure said arms in telescopic engagement with said sleeves.

25. A pole-type ladder according to claim 18, wherein said first mounting means comprises a generally U-shaped hook defining an opening and having a leg;

said first attachment means comprises a first sleeve on and positioned in axial alignment with said central section upper end and adapted to telescopically receive said hook leg, said first attachment means further comprising a first securing means for securing said hook leg in telescopic engagement with said first sleeve;

said second mounting means comprises a pair of curved arms; and said second attachment means comprises a pair of second sleeves secured to said first sleeve, positioned generally normal to said longitudinal axis of said central section, extending outwardly therefrom in generally opposite directions, and adapted to telescopically receive said arms, said second attachment means further comprising a second securing means for securing said arms in telescopic relationship to said second sleeves.

26. A pole-type ladder according to claim 23, wherein said first securing means comprises a pair of first openings extending through opposing walls of said first sleeve and first opening means extending through said hook leg and adapted to align with said first openings when said hook leg is telescopical received in said first sleeve, said first securing means further comprising a first pin adapted to engage said aligned first openings and opening means to secure said hook leg in telescopic engagement with said first sleeve; and said second securing means comprises a pair of second openings extending through opposing walls of each of said second sleeves and second opening means extending through an end of each of said arms, said second opening means being adapted to align with said second openings when said arms are telescopically received in said second sleeves, said second securing means further comprising a pair of second pins adapted to engage sets of aligned second openings and second opening means to secure said arms in telescopic engagement with said second sleeves.

* * * * *

UNITED STATES PATENT AND TRADEMARK OFFICE

CERTIFICATE OF CORRECTION

PATENT NO. : 4,844,207

DATED : July 4, 1989

INVENTOR(S) : DALE D. ANDREWS & DURWOOD T. ANDREWS

It is certified that error appears in the above-identified patent and that said Letters Patent is hereby corrected as shown below:

Col. 4, line 48, "change" should be --changeable--

Col. 4, line 53, "in" should be --interchangeable--

Col. 6, line 51, "he" should be --the--

Col. 12, line 18, "verse" should be --and parallel to said upper member, said upper, transverse--

Signed and Sealed this

Fifth Day of June, 1990

*Attest:*

HARRY F. MANBECK, JR.

*Attesting Officer*

*Commissioner of Patents and Trademarks*